US012185891B2

(12) United States Patent
Kaye et al.

(10) Patent No.: US 12,185,891 B2
(45) Date of Patent: Jan. 7, 2025

(54) CLEANING DEVICE WITH GRIPPING ASSEMBLY FOR A DISSOLVABLE CLEANING HEAD

(71) Applicant: Henkel AG & Co. KGaA, Düsseldorf (DE)

(72) Inventors: Glenn William Kaye, Norwalk, CT (US); Daniel Peter Sterling, Fairfield, CT (US); John Kevin Clay, Milford, CT (US)

(73) Assignee: Henkel AG & Co, KGaA, Dusseldorf (DE)

( * ) Notice: Subject to any disclaimer, the term of this patent is extended or adjusted under 35 U.S.C. 154(b) by 421 days.

(21) Appl. No.: 17/566,581

(22) Filed: Dec. 30, 2021

(65) Prior Publication Data

US 2023/0210337 A1 Jul. 6, 2023

(51) Int. Cl.

| | |
|---|---|
| ***A47L 13/17*** | (2006.01) |
| ***A47K 11/10*** | (2006.01) |
| ***A47L 13/46*** | (2006.01) |
| *A47L 13/16* | (2006.01) |

(52) U.S. Cl.

CPC ..... *A47L 13/17* (2013.01); *A47L 13/46* (2013.01); *A47K 11/10* (2013.01); *A47L 13/16* (2013.01)

(58) Field of Classification Search

CPC ..... A47L 13/17; A47L 13/46; A47L 13/16; A47K 11/10

See application file for complete search history.

(56) References Cited

U.S. PATENT DOCUMENTS

| | | | |
|---|---|---|---|
| 2,755,497 | A | 7/1956 | Greacen, Jr. |
| 4,031,673 | A | 6/1977 | Hagelberg |
| 5,630,243 | A | 5/1997 | Federico et al. |
| 6,094,771 | A | 8/2000 | Egolf et al. |
| D501,728 | S | 2/2005 | Conway et al. |
| D502,002 | S | 2/2005 | Conway et al. |
| D502,325 | S | 3/2005 | Hennel et al. |
| D518,260 | S | 3/2006 | Aubourg et al. |
| 7,059,008 | B2 | 6/2006 | Morgan et al. |
| 7,065,825 | B2 | 6/2006 | Minkler et al. |
| 7,127,768 | B2 | 10/2006 | Blum et al. |
| 7,146,676 | B2 | 12/2006 | Kubes et al. |
| 7,159,265 | B2 | 1/2007 | Soller et al. |

(Continued)

FOREIGN PATENT DOCUMENTS

| | | | |
|---|---|---|---|
| GB | 738299 | A | 10/1955 |
| GB | 2329325 | A | 3/1999 |

*Primary Examiner* — David Redding

(74) *Attorney, Agent, or Firm* — Blank Rome LLP

(57) ABSTRACT

A cleaning system includes a dissolvable cleaner head and a wand for removable attachment to the cleaner head. The cleaner head has a top surface, a bottom surface, and a height extending from the top surface to the bottom surface and includes an indentation having a depth same as the height of the cleaner head. The wand has a first end, a second end, and an attachment arrangement movable between an engaged position, wherein the wand is removably coupled to the cleaner head, and a disengaged position, wherein the wand is released from the cleaner head. The cleaner head also has a first sealing member sealing against the top surface of the cleaner head when engaged with the attachment arrangement and a second sealing member sealing against an inner surface of the indentation when engaged with the attachment arrangement to impede liquid intrusion toward the attachment arrangement.

20 Claims, 9 Drawing Sheets

(56) References Cited

U.S. PATENT DOCUMENTS

| | | | |
|---|---|---|---|
| 7,275,276 | B2 | 10/2007 | Jaszenovics et al. |
| 7,316,046 | B2 | 1/2008 | Michaels et al. |
| 7,386,910 | B2 | 6/2008 | Minkler et al. |
| 7,446,082 | B2 | 11/2008 | Kilkenny et al. |
| 7,470,652 | B2 | 12/2008 | Kilkenny et al. |
| D588,365 | S | 3/2009 | Conway et al. |
| 7,603,739 | B2 | 10/2009 | Minkler et al. |
| 7,650,663 | B2 | 1/2010 | Michaels et al. |
| 7,827,648 | B2 | 11/2010 | Soller et al. |
| 8,286,295 | B2 | 10/2012 | Minkler et al. |
| 9,021,649 | B2 | 5/2015 | Minkler et al. |
| 9,370,293 | B2 | 6/2016 | Butts et al. |
| 9,622,638 | B2 | 4/2017 | Butts et al. |

CLEANING DEVICE WITH GRIPPING ASSEMBLY FOR A DISSOLVABLE CLEANING HEAD

FIELD OF THE INVENTION

The present invention is in the field of household and industrial cleaning in applications for cleaning toilets. More particularly, the present invention relates to a cleaning system with a dissolvable cleaner block and a handling tool for the dissolvable cleaner block.

BACKGROUND OF THE INVENTION

Cleaning systems have been proposed for facilitating certain cleaning tasks. For example, toilet bowl cleaning systems have been proposed for cleaning inside a toilet and below the water line. These systems can make the cleaning process easier, more sanitary, etc.

Toilet brushes are typically used to swirl cleaning chemicals around a toilet bowl and then to scrub the sides of the bowl with those chemicals and water, so as to assist in removing stains along the bowl sides. After using such brushes, a consumer will typically attempt to rinse off the brush by swirling it in the bowl water. However, cleaning chemicals, feces, urine, and stray bits of paper typically found in the toilet can be retained on the brush or in its holder.

Various mechanical devices have been proposed to overcome disadvantages of a toilet brush having a permanently affixed head. Several commercially available products include a removable head that must be thrown away in the trash. Such conventional systems suffer from certain deficiencies. For example, the cleaning unit may not be robust enough to properly withstand the cleaning process because the water in the toilet, associated cleaning agents, and/or the scouring and scrubbing action may prematurely degrade the cleaning unit such that the system fails to clean the bowl to the user's satisfaction. Additionally, some cleaning systems suffer from poor ergonomics and are not user-friendly. Furthermore, the user may need to handle the cleaning unit after it is used (e.g., for disposal), which can be unsanitary and unpleasant. The use of these conventional systems may also generate undesirable amounts of waste when the cleaning units are flushed after use, thereby negatively impacting septic systems. Yet another disadvantage of the conventional systems is that they often include a large number of parts, which makes the manufacturing process inefficient and costly.

Many conventional cleaning systems utilize flushable heads that are water degradable as opposed to dissolvable. For example, GB 738,299 discloses a toilet cleaning device where the head is slipped into a swab and a toilet is then cleaned by wiping the swab around the surface of the bowl of the toilet. Removal of the swab is achieved by shouldering the swab against the rim of a toilet bowl and pulling the holder away to cause the swab to slip off, into the bowl, and dissolve prior to being flushed away. Other flushable and replaceable brush head elements are disclosed in e.g., U.S. Pat. Nos. 2,755,497, 4,031,673, 5,630,243, and 6,094,771 and GB 2,329,325. U.S. Pat. No. 7,650,663 discloses flushable heads that are insertable in a permanent type of wand. The brush head may be a stack of sheets of water-dissolvable material. The sheets are compressed to bind them together into a stack. Surface indentations and piercing of layers at the indentations are used to bind the brush head layers together securely without the need for binding adhesives, and to facilitate clamping. The heads, releasable from the wand, and are said to break up and behave like toilet paper, so they are flushable after use.

With such water degradable cleaning systems, oftentimes consumers will opt to discard these heads in their garbage for fear of clogging their toilets, as flushable heads take longer to break up and/or have the tendency to degrade incompletely. Water solubility (as opposed to degradability) is a desirable feature for a toilet cleaning "brush" because it allows the head to be flushed immediately after use, thereby avoiding the need to transport the dripping head to a garbage can and avoiding any odors that may develop if the brush head were left in a garbage can for some time period after use. It also avoids the potential for clogging that can occur when ingredients of a pad dissolve incompletely and/or take a long time to break up.

Thus, there exists an ongoing demand for improved cleaning systems, such as toilet bowl cleaning systems, that are highly robust and effective and that utilize solid unit dose cleaning compositions that can be attached to a wand apparatus to mechanically clean a toilet bowl surface and that are dissolvable in toilet water after they are used to clean the bowl. There is also a need for such cleaning systems to have improved ergonomics for facilitating use. Furthermore, there is a need for these cleaning systems to generate less waste and/or provide other environmental benefits. Moreover, there is a need for these cleaning systems to be manufactured efficiently. It is an object of the invention to provide improved cleaning systems that address these issues.

SUMMARY OF THE INVENTION

The foregoing objectives are achieved by provision of a cleaning system including a cleaner head and a wand for removable attachment to the cleaner head. The cleaner head has a top surface, a bottom surface, and a height extending from the top surface to the bottom surface. The cleaner head may include an indentation having a depth that is the same as the height of the cleaner head, or less than the height of the cleaner head, and may be dissolvable. The wand has a first end and a second end and includes an attachment arrangement adjacent the second end and movable between an engaged position, in which the wand may be removably coupled to the cleaner head, and a disengaged position, in which the wand may be released from the cleaner head. The wand may also include a first sealing member configured to engage with and seal against the top surface of the cleaner head when engaged with the attachment arrangement to impede liquid intrusion toward the attachment arrangement. Furthermore, the wand may include a second sealing member configured to engage with and seal against an inner surface of the indentation of the cleaner head when engaged with the attachment arrangement to impede liquid intrusion toward the attachment arrangement.

In some embodiments, the cleaner head may comprise surfactant, organic acid, and an organic acid buffering agent.

In certain embodiments, the wand includes a biasing member that biases the attachment arrangement in its engaged configuration.

In some embodiments of the cleaning system, the attachment arrangement includes an actuation member supported by the wand for axial movement between the first and second ends of the wand. The axial movement of the actuation member may move the attachment arrangement between the engaged position and the disengaged position. In some of these embodiments, the system also includes a control member slidably supported by the wand, wherein the control member is configured for manually moving the actuation member. In additional embodiments, the attachment arrangement may include a resilient outer sleeve coupled to the actuation member, wherein the axial movement of the actuation member results in radial expansion and contraction of the outer sleeve. The outer sleeve may engage with the cleaner head when in its radially expanded configuration and disengage from the cleaner head when in its radially contracted configuration. The axial movement of the actuation member towards the first end of the wand may move the outer sleeve into its radially expanded configuration engaged with the cleaner head. Further, the axial movement of the actuation member towards the second end of the wand may move the outer sleeve into its radially contracted configuration disengaged from the cleaner head.

In some embodiments, the first sealing member includes a terminal outer edge that is elastically resilient to conform to the top surface of the cleaner head.

In certain embodiments, the cleaner head further includes a retainer lip extending inwardly from the inner surface of the indentation. In some of these embodiments, the attachment arrangement removably engages with at least a portion of the retainer lip when in the engaged configuration. The second sealing member may engage with and seal against the retainer lip when engaged with the attachment arrangement to impede liquid intrusion from a bottom of the indentation toward the attachment arrangement.

In some embodiments, the wand extends along a wand axis and the wand includes a distal section supporting the attachment arrangement and having an axis, wherein the axis of the distal section is inclined with respect to the wand axis.

The cleaning system may also include a plurality of cleaner heads and a storage system for housing the wand and the plurality of cleaner heads.

The stated objectives are also achieved by provision of a wand for removable attachment to a dissolvable cleaner head. The wand includes an elongated shaft having a first end, a second end and an axis, and an attachment arrangement coupled to the second end and movable between an engaged position and a disengaged position. The attachment arrangement may include an outer sleeve configured to expand radially to engage the dissolvable cleaner head when in the engaged position, wherein the outer sleeve is configured to move radially inwardly when in the disengaged position to release the dissolvable cleaner head from the wand. The wand may also include a first sealing member configured to engage with and seal against a first portion the cleaner head when engaged with the attachment arrangement to impede liquid intrusion toward the attachment arrangement. Furthermore, the wand may include a second sealing member configured to engage with and seal against a second portion of the cleaner head when engaged with the attachment arrangement to impede liquid intrusion toward the attachment arrangement.

In some embodiments, the attachment arrangement includes an actuation member coupled to the outer sleeve and supported by the wand for axial movement between the first and second ends of the wand. The axial movement of the actuation member may move the attachment arrangement and the outer sleeve between the engaged position and the disengaged position. In certain of these embodiments, the wand may include a control member slidably supported by the wand, wherein the control member is configured for manually moving the actuation member. The control member may include a thumb slide configured for axial movement when engaged by a user's thumb. The wand may further include a linkage system extending along the axis that operatively connects the actuation member and the control member such that a manual selection input to the control member results in the actuation member moving between the engaged position and the disengaged position. In additional embodiments, the linkage system includes a biasing member, wherein the biasing member biases the actuation member into the engaged position with the dissolvable cleaner head without any manual input to the control member. The manual input to the control member may overcome a spring force of the biasing member to move the actuation member into the disengaged configuration releasing the dissolvable cleaner head from the wand.

The foregoing statements are provided by way of non-limiting example only. Various additional examples, aspects, and other features of embodiments of the present disclosure are encompassed by the present disclosure and described in more detail below.

BRIEF DESCRIPTION OF THE DRAWINGS

The accompanying drawings are included to provide a further understanding of the present disclosure. The drawings illustrate exemplary embodiments of the present disclosure; however, the drawings are merely provided for reference and illustration, without any intention to be used for limiting the present disclosure.

DETAILED DESCRIPTION OF THE INVENTION

Figure 1:
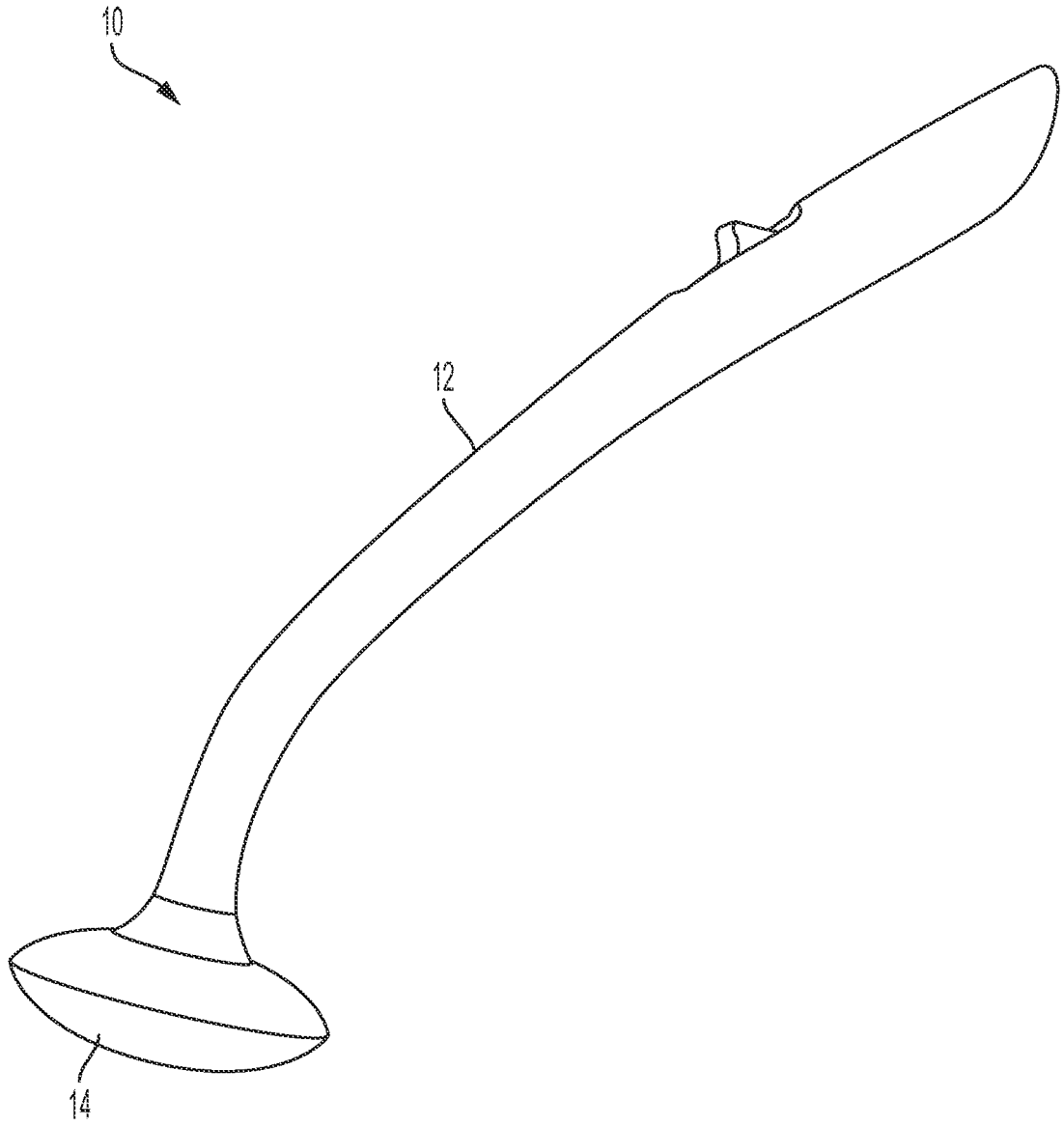
FIG. 1 is a side view of a cleaning system according to exemplary embodiments of the present invention.

The following description provides specific details, such as materials and amounts, to provide a thorough understanding of the present invention. The skilled artisan, however, will appreciate that the present invention can be practiced without employing these specific details. Indeed, the present invention can be practiced in conjunction with processing, manufacturing or fabricating techniques conventionally used in the homecare industry.

Except in the operating and comparative examples, or where otherwise explicitly indicated, all numbers in this description indicating amounts or ratios of material or conditions of reaction, physical properties of materials and/or use are to be understood as modified by the word "about".

The term "about" as used in connection with a numerical value throughout the specification and the claims denotes an interval of accuracy, familiar and acceptable to a person skilled in the art. In general, such interval of accuracy is +−10%. Thus, "about ten" means 9 to 11. All numbers in this description indicating amounts, ratios of materials, physical properties of materials, and/or use are to be understood as modified by the word "about," except as otherwise explicitly indicated.

"Cleaning" means to perform or aid in soil removal, bleaching, microbial population reduction, or combination thereof.

As used herein, the term "comprising" means including, made up of, composed, characterized by, or having.

Generally, the present disclosure relates to a cleaning system, such as a cleaning system for cleaning a toilet bowl. The system may generally include a handling tool (wand) and a removably attached cleaning head. The cleaner head may be a dissolvable unit, such that it begins dissolving when exposed to liquid (e.g., water in a toilet bowl). The shape, construction, material characteristics, etc. of the cleaner head may allow it to be scrubbed, scoured, and rubbed against the inner surface of the toilet bowl for cleaning purposes. The cleaner head may dissolve eventually, but slowly enough to maintain sufficient scrubbing, scouring, rubbing, or other cleaning action during use.

The cleaner head may be made with a solid cleaning composition, which refers to a cleaning composition in the form of a solid for example, a granule, a pellet, a tablet, a lozenge, a puck, a briquette, a brick, a solid block, or a unit dose. The term "solid" refers to the state of the cleaning composition under the expected conditions of storage and use of the solid detergent composition. In general, it is expected that the cleaning composition will remain in solid form when exposed to temperatures of up to about 100° F.

In some embodiments, the solid cleaning composition may be a stable solid, which means that retains its shape under conditions in which the composition may be stored or handled.

The cleaner head may be a solid unit dose, which refers to a cleaning composition unit sized so that the entire unit is used during a single cleaning cycle. When the cleaner head is provided as a unit dose, it is preferably provided as a compressed solid, such as a tablet having a size of between about 1 gram and about 50 grams. Furthermore, it should be appreciated that the solid unit dose head can be provided so that a plurality of the solids will be available in a package having a size of between about 40 grams and about 1,000 grams. The solid unit dose may be in various compressed, cast, or extruded forms including, for example, pellets, blocks, and tablets.

The cleaning system also includes features that improve manufacturing efficiency and produce less waste. For example, the cleaner head may be constructed from dissolvable material, which dissolves during and after use, and which may be flushed away safely. Furthermore, the handling tool may include relatively few parts and may be reusable. Additionally, manufacture of the handling tool and the cleaner head may be relatively simple and inexpensive for increased efficiencies.

An exemplary cleaning system 10 of the present invention is shown in FIG. 1. The cleaning system may generally include a wand 12 and a cleaner head 14. The wand 12 may be removably attached to the cleaner head 14. The cleaning system 10 may be configured for manually cleaning, scrubbing, scouring, or otherwise sanitizing a toilet, including areas below the waterline. However, it is understood that the cleaning system 10 may be configured for other uses without departing from the scope of the present disclosure. For example, the cleaning system 10 may be configured for cleaning sinks, drains, bathtubs, showers, or other areas.

An exemplary embodiment of the cleaner head 14 is shown in FIGS. 6*a*-6*b* and 7*a*-7*b*. The cleaner head 14 may be disc-like or puck-shaped or have any other desirable shape. The various embodiments of the cleaner head 14 have a top surface 18, a bottom surface 20, a height Ha extending from the top surface to the bottom surface, and a diameter Da. The top and/or bottom surfaces of the head 14 may be rounded (e.g., annular or circular) and may extend in a circumferential direction about an axis 22. The cleaner head 14 is shown as substantially cylindrical and having a diameter but it may take other shapes.

Figure 7A:
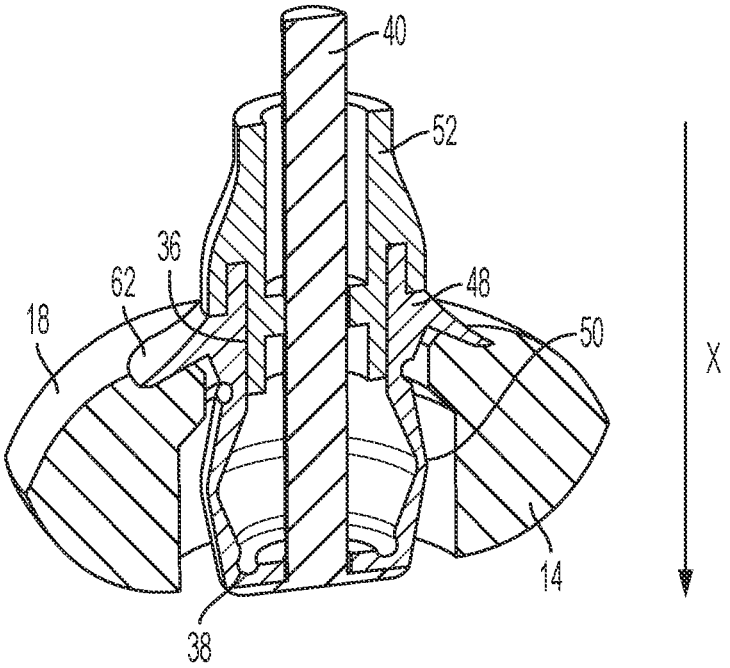
FIG. 7*a* is a cross-sectional view of an end of the cleaning system with an attachment arrangement of the wand shown in a first position according to example embodiments of the present invention.
Figure 7B:
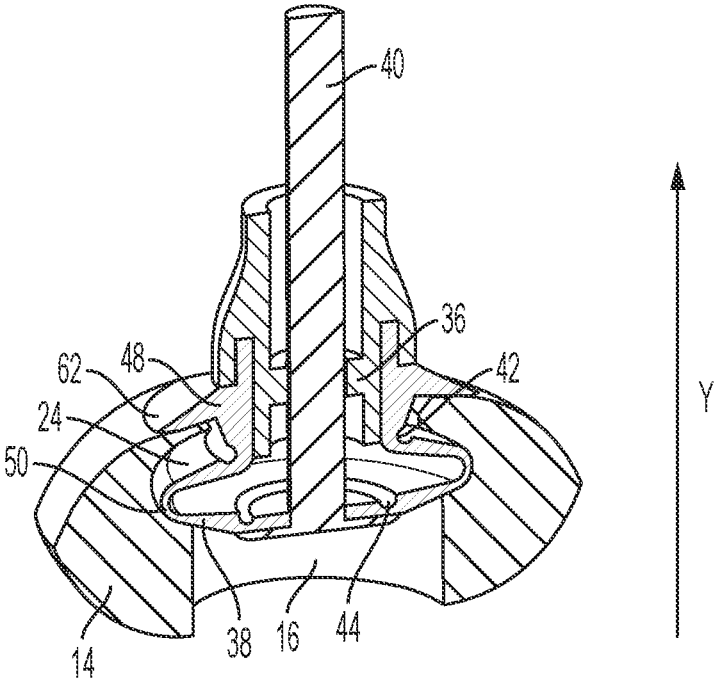
FIG. 7*b* is a cross-sectional view of an end of the cleaning system with an attachment arrangement of the wand shown in a second position according to example embodiments of the present invention.

The cleaner head 14 comprises a indentation or indentation 16 in at least one of its surfaces that is adapted to receive and engage the wand 12, as shown in FIGS. 7*a*-7*b*. The indentation has a height Hb and a diameter Db. The diameter Db of the indentation 16 is less than the diameter Da of the cleaner head 14. The depth or height Hb of the indentation is the same as height Ha of the head 14 or may be less than the height Ha. Preferably, the indentation 16 is from about 25% to about 100% of the height of the head 14.

Figure 6A:
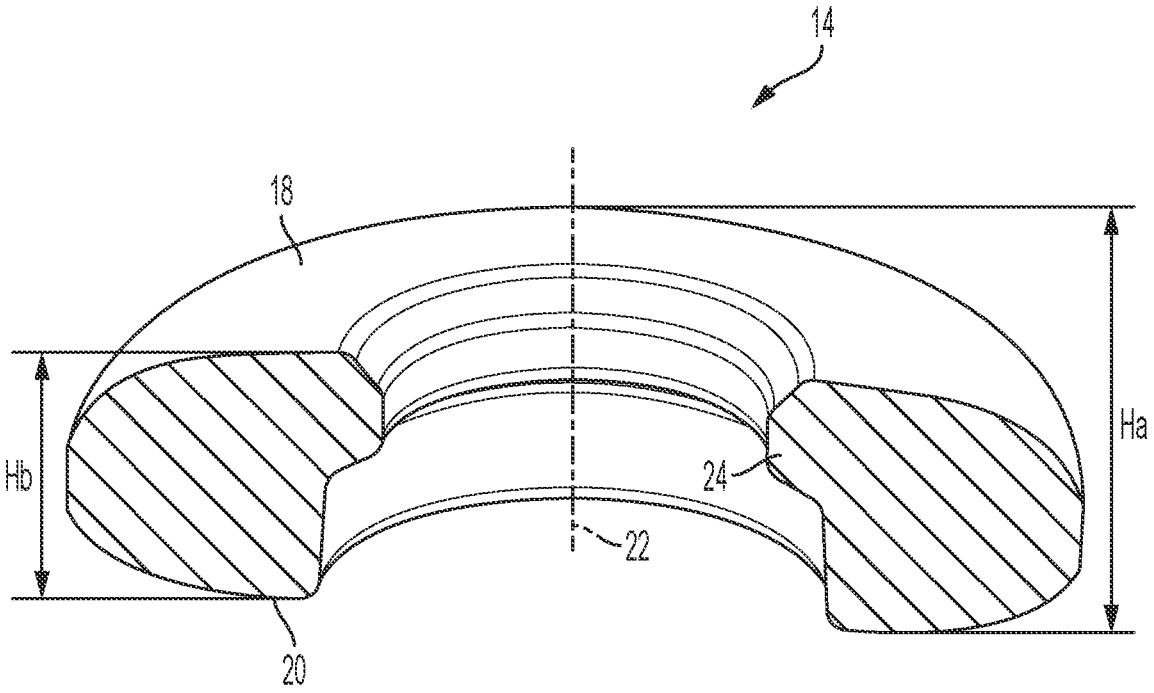
FIG. 6*a* is a cross-sectional view of a cleaning head of the cleaning system of FIG. 1.
Figure 6B:
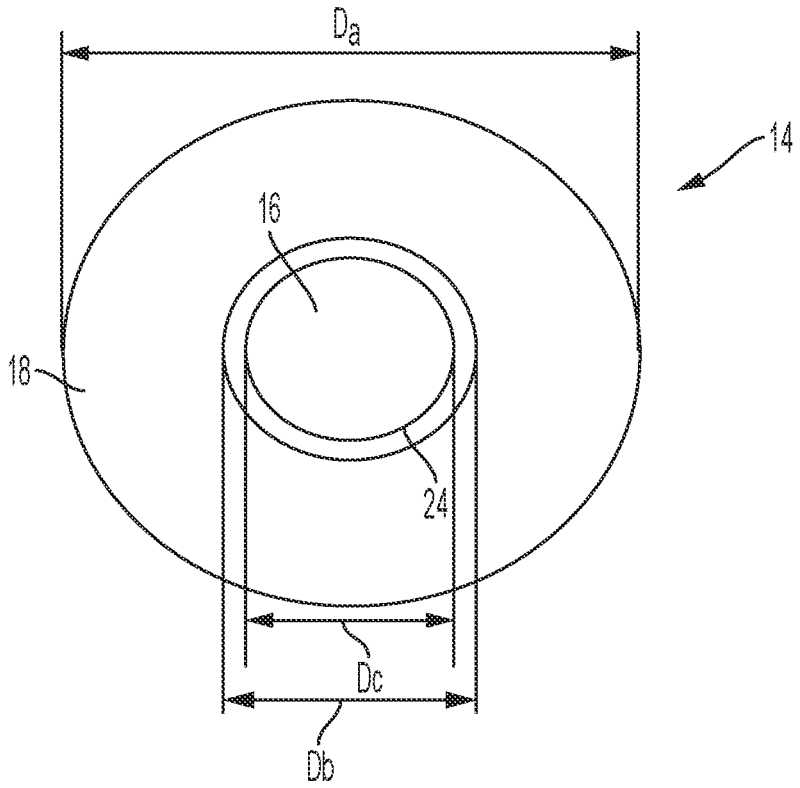
FIG. 6*b* is a top view of a cleaning head of the cleaning system of FIG. 1.

The indentation may include a retainer lip 24 adjacent the top surface 18 of the cleaner head 14, as shown in FIGS. 6*a*-6*b*. The retainer lip 24 has an inner diameter Dc that is smaller than the diameter Db of remainder of the indentation 16. The lip 24 may have a rounded edge or may have other suitable shapes and may extend circumferentially around the axis 22. The retainer lip 24 may be formed out of the same material as the remainder of the cleaner head. The retainer lip functions to engage with the wand 12, as discussed in more detail below.

In certain embodiments, the solid unit dose cleaner head 14 weighs about 1 to about 70 grams, more preferably about 10 to about 50 grams, most preferably about 20 to about 40 grams. In some embodiments, the solid unit dose cleaner head has height of about 0.5 cm to about 10 cm, more preferably about 0.8 cm to about 1 cm. In other embodiments, the cleaner head has a height of about 5 to about 10 cm. In yet other embodiments, the cleaner head has a height of about 0.45 to about 0.8 inches, preferably 0.5 to 0.7 inches, more preferably 0.55 to 0.65 inches. Typically, the solid unit dose cleaner head will have a diameter of about 1.5 to about 3 inches, preferably 1.75 to 2.5 inches, more preferably 2 to 2.375 inches. In certain embodiments, the solid unit dose cleaner head has a height to diameter ratio between 0.2 and 0.3.

In some embodiments, the solid unit dose cleaner head is a tablet having a hardness of at least 15 N, more preferably at least 20 N, most preferably at least 30 N. In preferred embodiments, the tablet has a hardness greater than 50 N.

The cleaner head 14 may be in various forms including, for example, pellets, blocks, and tablets, but not powders. In some embodiments, the material of the cleaner head 14 may be dissolvable upon contact with liquid, such as toilet bowl water. This material may include powder or other solid material that has been compacted (e.g., in a mold, press, etc.) to define the shape of the head 14, including the indentation 16 and the lip 24. The material included in the cleaner head may include one or more cleaning agents, disinfecting agents, abrasive agents, perfume or fragrant materials, surfactants, nonionic surfactants, acids, bases, antimicrobial active ingredients, preservatives, chelating agents, polymers, colorants, builders, bleaching agents, corrosion inhibitors, flush regulators, active ingredients to reduce stickiness, and/or enzymes.

The material on the outer surface of the cleaner head 14 may begin dissolving, foaming, or otherwise reacting as the head 14 is exposed to liquid. As the head 14 is scrubbed against the interior of the toilet bowl, the head 14 may continue to break down and reduce. The material used to construct the head 14 may be configured so that it dissolves eventually and at a controlled rate. Furthermore, as discussed below, the wand 12 may include features that protect its removable attachment to the cleaner head 14 to prevent premature dissolution and disintegration of the head 14.

In preferred embodiments, the cleaning composition of the cleaner head 14 provides cleaning efficacy, a foaming visual cue, fragrance sensorial experience and slowly dissolves so one does not have to re-store or throw away the cleaner head portion of the product. The toilet cleaner head is advantageously dissolvable, which negates the need for the consumer to store an unpleasant, bacteria filled cleaning tool.

The cleaner head 14 may be ergonomically attached to the wand 12, may remain securely attached to the wand 12 during use, and then may be selectively detached and released from the wand 12 when manual scrubbing of the toilet is complete. The cleaner head 14 may thus be released from the wand 12 into the toilet bowl water to further dissolve and the material may be flushed away in some embodiments. The wand 12 may be reused later and removably attached to a replacement cleaner head 13. Accordingly, the cleaning system 10 produces little-to-no solid waste.

Figure 2:
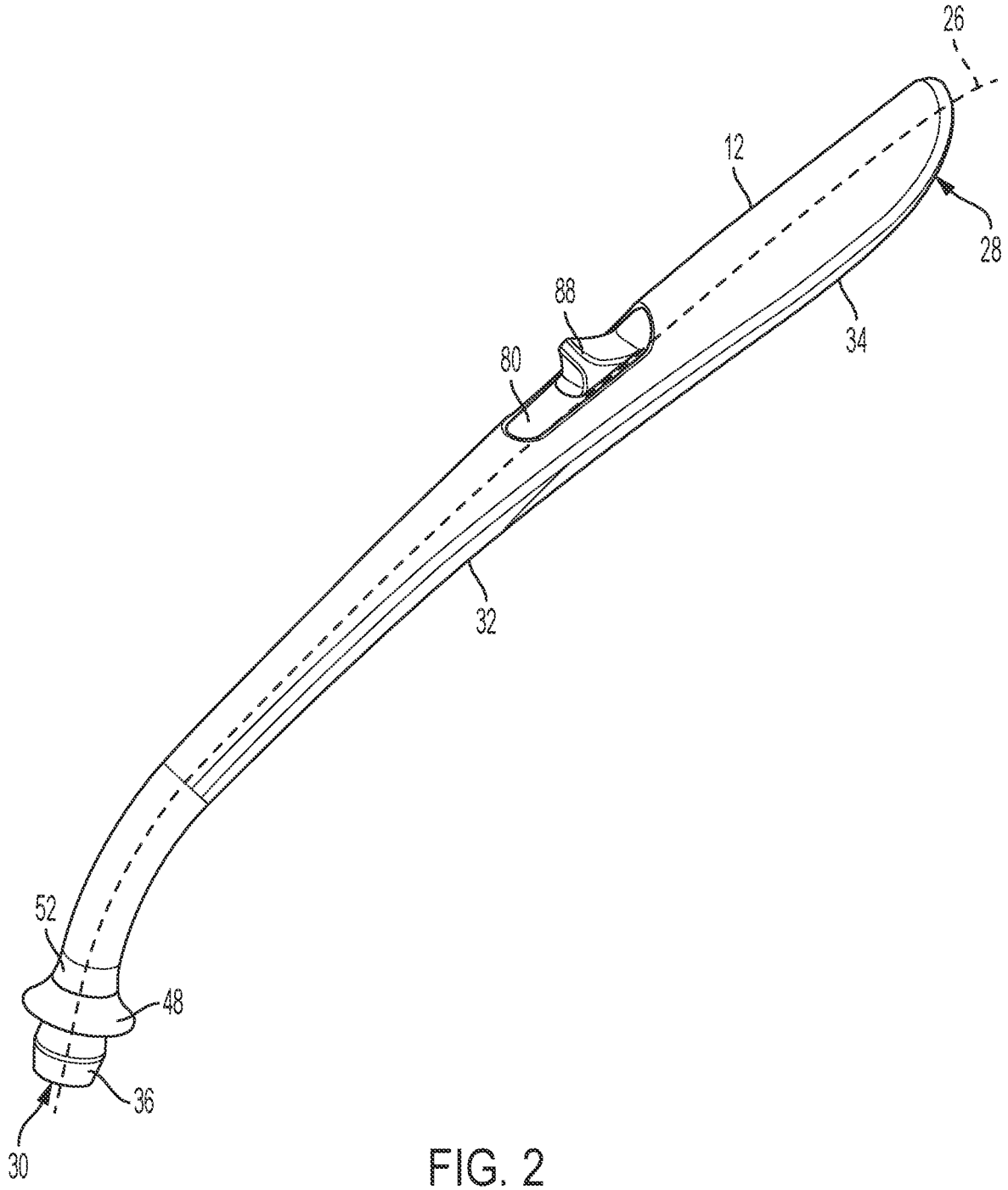
FIG. 2 is a side view of a wand of the cleaning system of FIG. 1.
Figure 3:
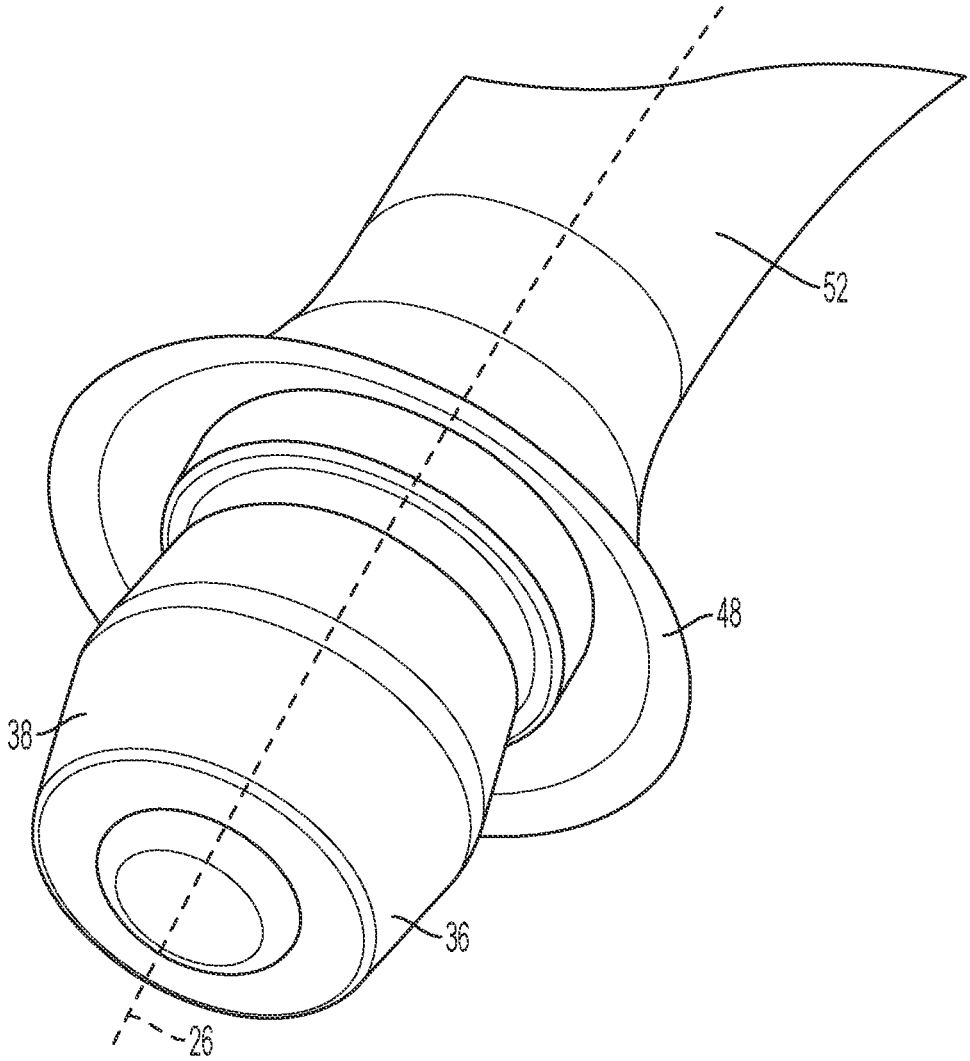
FIG. 3 is an enlarged bottom perspective view of an end of the wand of FIG. 2.
Figure 4:
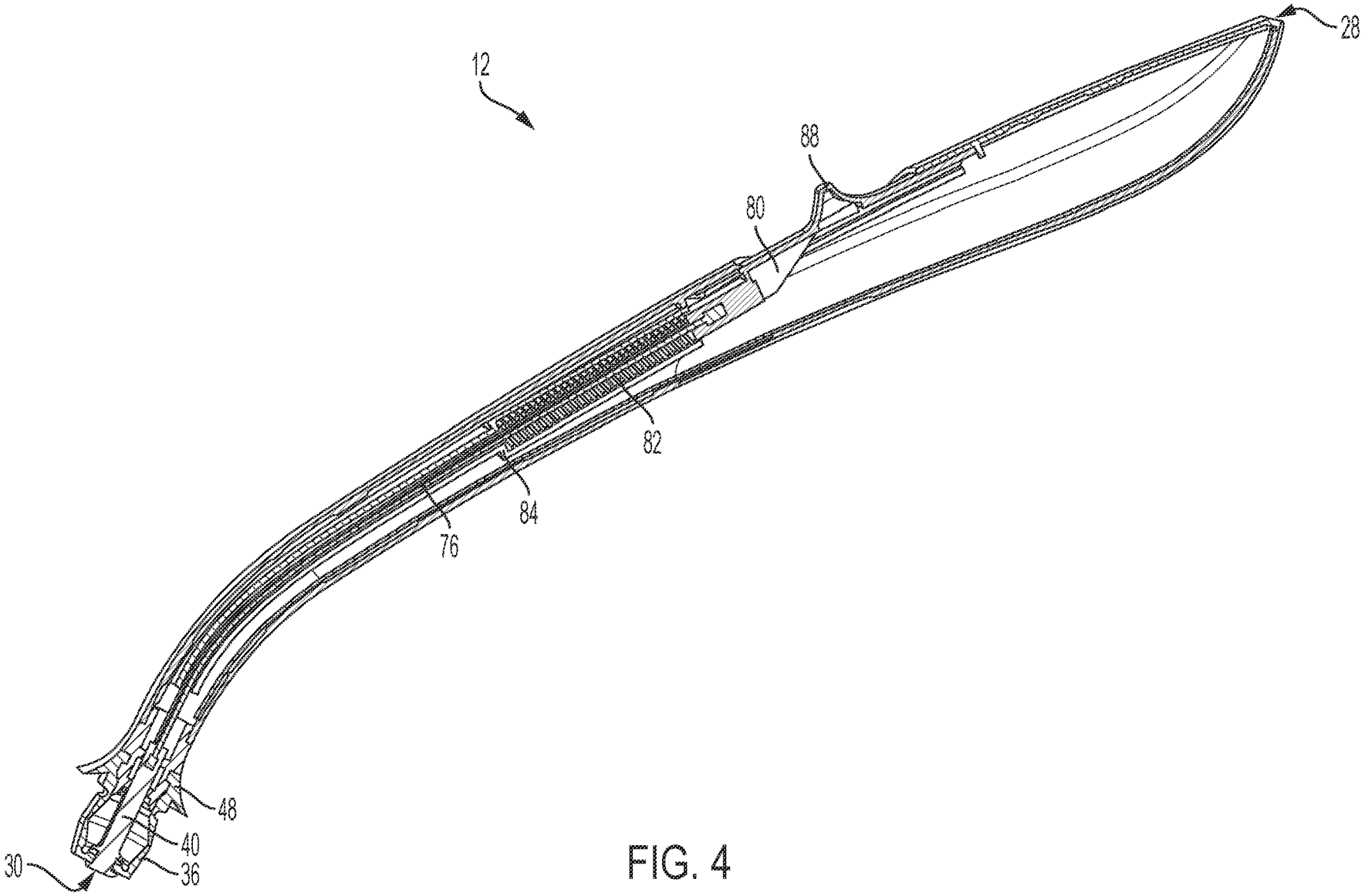
FIG. 4 is a cross-sectional view of the wand of FIG. 2.

Further details of an exemplary embodiment of the wand are shown in FIGS. 2-4. The wand 12 may have an elongate body that extends along the axis 26 (i.e., the wand axis or system axis) between a first end 28 and a second end 30. The axis 26 of the wand 12 may be linear or may be curved. In some embodiments, a portion of the wand 12 adjacent the second end 30 may have a curved shape to improve ergonomics and make the system easier to use during a cleaning operation such that it can reach all areas of the toilet bowl including under the rim. The wand 12 further comprises an elongated shaft 32 that extends between the first and second ends of the wand. The shaft portion 32 may be made as one piece or may include two or more shaft portions connected together (e.g., via a snap-fit, via fasteners, etc.) to define a hollow housing for components discussed below. The shaft 32 may be constructed from a polymeric or composite material and may be rigid, thin-walled and hollow inside to house other components of the wand 12.

The wand 12 may further include a grip portion 34 disposed adjacent the first end 28. The grip portion 34 functions to provide a gripping surface for a user's hand when handling the cleaning system. The grip portion 34 may include features that improve gripping such as, e.g., contoured surfaces, compressible material, high-friction material or other features that correspond to the hand and fingers and assist with gripping.

As shown in the enlarged view in FIG. 3, the second end 30 of the wand 12 includes an attachment arrangement 36 for engaging with the cleaner head 14. The attachment arrangement may be attached to and supported by the wand 12. The attachment arrangement 36 is moveable between an engaged position, as shown in FIG. 7*b*, and disengaged position, as shown in FIG. 7*a*. When in the engaged position, the attachment arrangement is removably attached to the cleaner head 14. Once moved to the disengaged position, the cleaner head 14 is released from the attachment arrangement and the wand.

Figure 5:
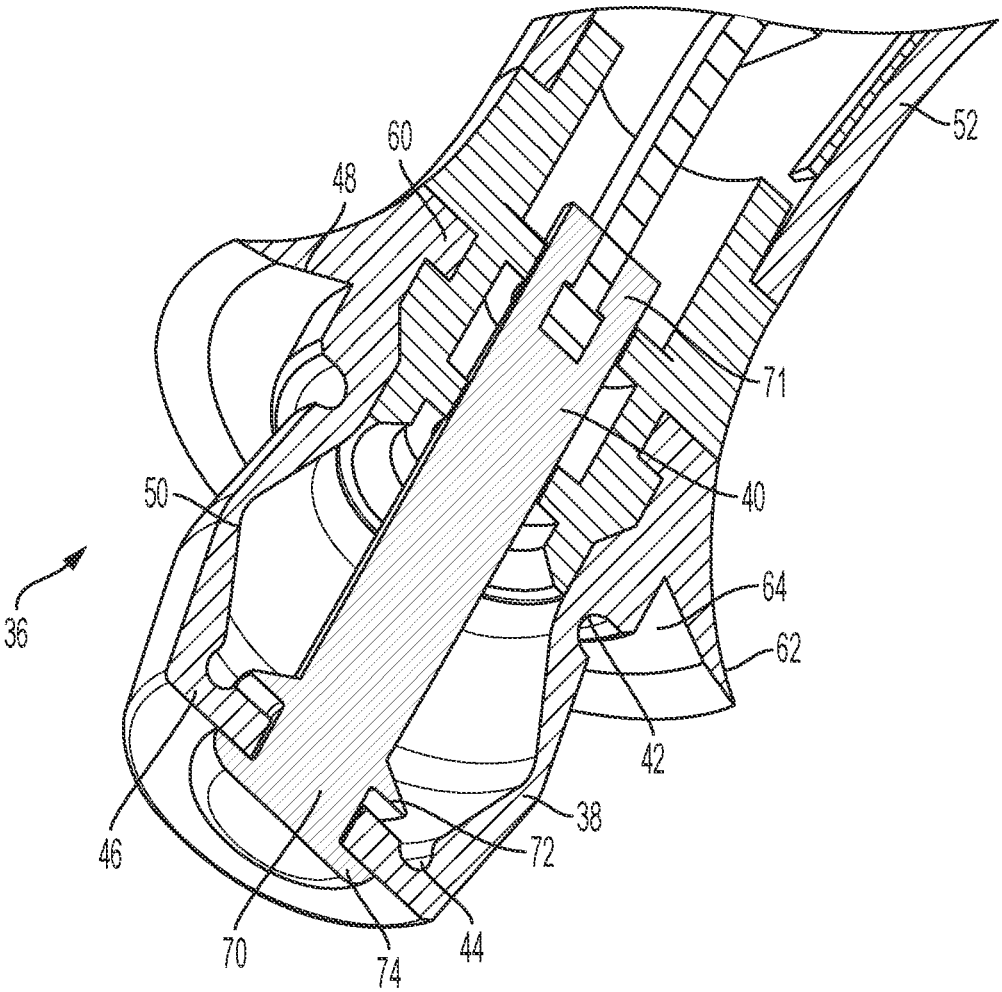
FIG. 5 is an enlarged cross-sectional view of the end of the wand of FIG. 3.

The attachment arrangement may include an outer sleeve 38, as shown in the cross-sectional view in FIG. 5, that houses the actuation member 40 of the attachment arrangement. The outer sleeve 38 may be a unitary, one-piece part made out of a polymer, such as, e.g., rubber or a thermoplastic elastomer (TPE), or other suitable material. In some embodiments, the outer sleeve 38 may be made by a molding or a casting process. The outer sleeve 38 may be hollow and sufficiently flexible to allow the sleeve to expand and retract radially when the actuation member 40 is moved axially, as shown in FIGS. 7*a* and 7*b*. The outer sleeve 38 may have a generally cylindrical shape with a side wall extending circumferentially around the axis 26. The outer sleeve 38 may also include a sealing collar 48 above the cylindrical portion, as discussed in more detail below.

The outer sleeve 38 may further includes an attachment portion 52 that attaches the attachment arrangement 36 to the wand 12. In some embodiments, the attachment arrangement 36 may be attached to the wand 12 by pulling the outer sleeve onto the wand 12 like a sock. The outer sleeve 38 may have material resiliency for compressing onto and frictionally attaching to the wand 12. In additional embodiments, the attachment arrangement 36 may be attached to the wand 12 via a snap- or screw-type arrangement, or other suitable attachment mechanisms.

In some embodiments, the side wall of the outer sleeve 38 has a middle section 50 of a larger diameter, wherein the sidewall tapers inwardly from the middle section towards each end of the outer sleeve. Such design assists with the radial expansion of the outer sleeve 38 when the sleeve is compressed axially via the actuation member 40.

The outer sleeve 38 may also include one or more notches in the sidewall that further facilitate the radial expansion of the sleeve. For example, the sidewall of the outer sleeve 38 may have a notch 44 adjacent the distal end 46 of the sleeve and may further have a notch 42 adjacent the sealing collar 48. When the actuation member 40 is moved axially in the direction "Y" shown in FIG. 7*b*, the notch 44 on the inner side of the sidewall allows the bottom portion of the outer sleeve 38 between the distal end 46 and the middle section 50 to flatten. At the same time, the notch 42 on the outer side of the sidewall allows the sidewall between the middle section 50 and the sealing collar 48 to move outward and flatten. This facilitates the radial expansion of the outer sleeve 38 when the attachment arrangement is brought into its engaged position. It is understood that the number and positioning of the notches may be varied as desired.

The sealing collar 48 may be a relatively thin sheet or membrane and preferably is resilient and elastic. As shown in FIGS. 3 and 5, the sealing collar 48 may be skirt shaped. The sealing collar 48 may include an upper end 60 that attaches to the attachment portion 52 and a lower outer edge 62 that is disposed outward radially relative the outer sleeve 38. The sealing collar 48 may flare outward gradually and may define a conic space 64 between the outer sleeve 38 and the inner surface of the sealing collar 48.

As shown in FIGS. 7*a* and 7*b*, the sealing collar 48 may lie against and abut the cleaner head 14. The sealing collar 48 may push against and resiliently flex against the cleaner head 14, with the outer edge 62 resiliently flexing, folding, or otherwise deforming to conform against the surface 18 of the cleaner head 14 to form a liquid barrier and seal against the dissolvable cleaner head 14. During use in the toilet bowl, the sealing collar 48 may seal against the surface 18 of the cleaner head 14 to impede the water from reaching the attachment arrangement 36 and its direct attachment to the cleaner head. This way, even though the wand 12 is directly attached to the cleaner head 14, the sealing collar 48 delays dissolving action and makes the attachment robust enough to withstand the toilet cleaning process.

Additionally, the upper portion of the outer sleeve 38 may abut against the retainer lip 24 of the cleaner head 14 when the attachment arrangement 36 is in its engaged configuration, as shown in FIG. 7*b*. This abutment creates anther liquid barrier and seal between the outer sleeve and the bottom portion of the retainer lip 24 to impede the water from reaching the direct attachment arrangement between the outer sleeve and the cleaner head 14. This is important because the structure of the cleaner head 14 having a through hole or indentation 16 allows the water in the toilet bowl to enter the cleaner head from the bottom and cause dissolution of the cleaner head retaining lip 24, which can impair the strength of the attachment between the wand 12 and the cleaner head 14 during the cleaning operation. This additional seal between the outer sleeve 38 and the retaining lip 24 delays dissolving action and makes the attachment robust enough to withstand the toilet cleaning process.

The actuation member 40 is movably arranged inside the outer sleeve 38 and is capable of axial movement in X and Y directions, as shown in FIGS. 7*a* and 7*b*. The actuation member 40 may be generally cylindrical in shape and have a distal end 70 and a proximal end 71, as seen in FIG. 5. The distal end 70 may have a first projection 74 and a second projection 72 positioned proximally from the first projection 74, creating an annular space therebetween. The distal end 46 of the outer sleeve 38 may have an annular indentation through which the distal end 70 of the actuation member 40 is inserted such that the distal bottom wall of the outer sleeve 38 is received in the annular space between the first and second projections 72, 74 of the actuation member 40. The first and second projections may have a diameter that is larger than the diameter of the remainder of the actuation member 40 and larger than the diameter of the indentation of the outer sleeve 38. This creates an engagement arrangement between the actuation member 40 and the outer sleeve 38 such that the axial movement of the actuation member 40 causes radial expansion or retraction of the outer sleeve 38.

As shown in FIG. 4, the wand 12 further includes a linkage system 76 that connects the actuation member 40 with a user control member 80 positioned adjacent the grip portion of the wand. The linkage system 76 may include one or more elongate cords, cables, pulleys, ties, lines, geartrains, or other linkage members that extend along the axis 26 between the first end 28 and the second end 30 of the wand 12 and operatively connect/couple the control member 80 to the actuation member 40. In some embodiments, the linkage system 76 may be substantially contained within the shaft portion(s) of the wand and supported for movement within the wand.

The linkage system 76 may include a cable or other elongate and flexible member. One end of the cable may be connected to the control member 80 and the other end may be connected to the actuation member 40. The linkage system 76 may also include a biasing member 82, such as a helical spring, a leaf spring, a resiliently bendable member, or other suitable biasing mechanism. The biasing member 82 may be positioned adjacent the control member 80 inside the wand shaft or at another suitable location inside the wand shaft. The biasing member may be seated against a shaft seat 84 at one end and against the control member 80 at the other end. The shaft seat 84 may be annular and the cable may pass through the seat 84 (and the biasing member 82) to attach to the control member 80.

The control member 80 may include a thumb slide 88 movably received in the wand shaft. The thumb slide 88 is configured to translate axially when engaged by the user's thumb, which in turn causes axial movement of the cable of the linkage system 76, causing axial movement of the actuation member 40 in the directions X and Y shown in FIGS. 7*a* and 7*b*. The biasing member 82 is configured such that in its relaxed rest state, the actuation member is retracted and the attachment arrangement 36 is in its engaged configuration shown in FIG. 7*b*. When the thumb slide 88 is engaged by the user and moved forward towards the second end 30 of the wand 12, it compresses the biasing member 82 and causes the axial movement of the actuation member 40 in the direction X, bringing the attachment arrangement 36 into its disengaged configuration shown in FIG. 7*a*. Once the thumb slide 88 is released, the biasing member 82 relaxes to its rest state, which causes axial movement of the actuation member 40 in the direction Y, bringing the attachment arrangement 36 back to the engaged configuration shown in FIG. 7*b*.

The cleaning system 10 of the present disclosure may be supplied to the consumer with the cleaner head 14 already attached to the wand 12. In this case, the attachment arrangement 36 is in the engaged configuration with the cleaner head 14, as shown in FIG. 7*b*, via the force of the biasing member 82 being in its relaxed rest configuration. The actuation member 40 is retracted axially and the outer sleeve 38 is expanded radially such that it "grabs" onto the interior surface of the retaining lip 24 of the cleaner head. The biasing member 82 applies constant pressure to maintain tight attachment and seal between the attachment arrangement 36 and the cleaner head 14. When the consumer is finished with the cleaning session, they can slide the thumb slide 88 forward, causing the biasing member 82 to compress and causing the actuation member 40 to move in the direction X. This in turn causes the outer sleeve 38 to retract radially and disengage from the retainer lip 24 of the cleaning head 14, creating a path to let the cleaner head fall into the toilet bowl where it will foam and dissolve until it can be flushed away. The wand 12 may then be reused with a new cleaner head.

Figure 8:
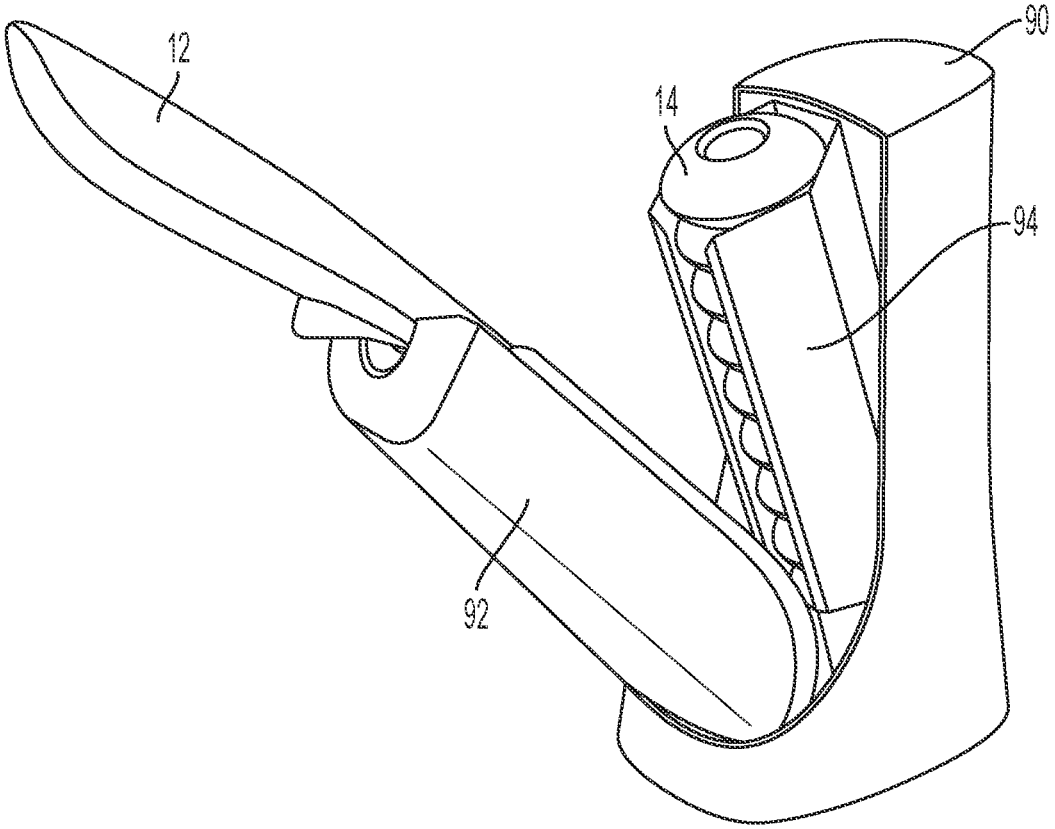
FIG. 8 shows an exemplary caddy system that can hold a wand and a plurality of cleaner heads described herein.

In other embodiments, the wand 12 may be supplied separately from the cleaner head 14. For example, the user may purchase one or more cleaner heads and the wand separately or as a part of the cleaning kit. For example, as shown in FIG. 8, a plurality of cleaner heads 14 may be packaged together. A plurality of tablets may be stored in a caddy 90 with the wand 12 stored separately. When the consumer wants to clean the toilet, he or she may take the wand 12 out of a wand storage sleeve 92. The consumer may slide the thumb slide 88 forward, moving the actuation member in the direction X and bringing the attachment arrangement 36 into its disengaged configuration. Then, the consumer may insert the second end 30 of the wand 12 into the indentation 16 in the cleaner head 14 positioned on top in a cleaner head storage sleeve 94. Once the outer sleeve portion below the sealing collar is positioned below the retainer lip of the cleaner head, the consumer may release the thumb slide, which will cause the biasing member to expand and assume its relaxed state. This will cause the actuation member to retract axially in the direction Y and bring the attachment arrangement 36 into its engaged configuration with the cleaner head, as shown in FIG. 7*b*. The consumer may then carry out the cleaning operation and dispose of the cleaner head at the end, as discussed above.

The wand may then be placed back in the wand storage sleeve 92 ready for use with a new cleaner head. The consumer may purchase additional cleaner heads to replace the heads used for cleaning.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration in any way. Rather, the foregoing detailed description will provide those skilled in the art with a convenient road map for implementing an exemplary embodiment. It should be understood that various changes may be made in the function and arrangement of elements described in an exemplary embodiment without departing from the scope of the subject matter as set forth in this application.

What is claimed is:

1. A cleaning system comprising:

a dissolvable cleaner head having a top surface, a bottom surface, and a height extending from the top surface to the bottom surface, wherein the dissolvable cleaner head defines an indentation extending through the dissolvable cleaner head; and a wand configured to be removably attached to the dissolvable cleaner head, the wand extending between a first end and a second end, and the wand comprising:

an attachment arrangement adjacent the second end and configured to move between an engaged position, in which the wand is removably attached to the dissolvable cleaner head, and a disengaged position, in which the wand is released from the dissolvable cleaner head, wherein the attachment arrangement comprises an actuation member and an outer sleeve coupled to the actuation member, and wherein the actuation member is configured to move axially between the first end and the second end of the wand, such that the axial movement of the actuation member causes the outer sleeve to radially expand thereby moving the attachment arrangement to the engaged position, and causes the outer sleeve to radially contract thereby moving the attachment arrangement to the disengaged position;

a first sealing member configured to engage with and seal against the top surface of the dissolvable cleaner head when the attachment arrangement is in the engaged position to impede liquid flow toward the attachment arrangement; and a second sealing member configured to engage with and seal against an inner surface of the indentation of the dissolvable cleaner head when the attachment arrangement is in the engaged position to impede liquid flow toward the attachment arrangement.

2. The cleaning system of claim 1, wherein the dissolvable cleaner head comprises a surfactant, an organic acid, and a buffering agent.

3. The cleaning system of claim 1, wherein the wand further comprises a biasing member configured to bias the attachment arrangement to the engaged position.

4. The cleaning system of claim 1, wherein the wand further comprises a control member configured to cause the axial movement of the actuation member.

5. The cleaning system of claim 1, wherein the outer sleeve is configured to engage with the dissolvable cleaner head when the outer sleeve is radially expanded, and is configured to disengage from the dissolvable cleaner head when the outer sleeve is radially contracted.

6. The cleaning system of claim 1, wherein the axial movement of the actuation member towards the first end of the wand causes the outer sleeve to radially expand, and the axial movement of the actuation member towards the second end of the wand causes the outer sleeve to radially contract.

7. The cleaning system of claim 1, wherein the first sealing member comprises an outer edge that is elastically resilient to conform to the top surface of the dissolvable cleaner head.

8. The cleaning system of claim 1, wherein the dissolvable cleaner head further comprises a retainer lip extending inwardly from the inner surface of the indentation.

9. The cleaning system of claim 8, wherein the attachment arrangement removably engages with at least a portion of the retainer lip when in the engaged position.

10. The cleaning system of claim 8, wherein the second sealing member is configured to engage with and seal against the retainer lip when engaged with the attachment arrangement to impede liquid flow from a bottom of the indentation toward the attachment arrangement.

11. The cleaning system of claim 1, wherein a proximal section of the wand including the first end extends along a wand axis, wherein a distal section of the wand including the second end supporting the attachment arrangement extends along a support axis, and wherein the support axis is inclined with respect to the wand axis.

12. The cleaning system of claim 1, further comprising a plurality of cleaner heads including the cleaning head, and a housing configured to store the wand and the plurality of cleaner heads.

13. A cleaning system comprising:

a dissolvable cleaner head having a top surface, a bottom surface, and a height extending from the top surface to the bottom surface, wherein the dissolvable cleaner head defines an indentation extending through the dissolvable cleaner head and comprises a retainer lip extending inwardly from an inner surface of the indentation; and a wand configured to be removably attached to the dissolvable cleaner head, the wand extending between a first end and a second end, and the wand comprising:

an attachment arrangement adjacent the second end and configured to move between an engaged position, in which the wand is removably attached to the dissolvable cleaner head, and a disengaged position, in which the wand is released from the dissolvable cleaner head;

a first sealing member configured to engage with and seal against the top surface of the dissolvable cleaner head when the attachment arrangement is in the engaged position to impede liquid flow toward the attachment arrangement; and a second sealing member configured to engage with and seal against the retainer lip when the attachment arrangement is in the engaged position to impede liquid flow toward the attachment arrangement.

14. The cleaning system of claim 13, wherein the dissolvable cleaner head comprises a surfactant, an organic acid, and a buffering agent.

15. The cleaning system of claim 13, wherein the attachment arrangement comprises an actuation member configured to move axially between the first end and the second end of the wand, such that the axial movement of the actuation member causes movement of the attachment arrangement to the engaged position, and causes movement the attachment arrangement to the disengaged position.

16. The cleaning system of claim 15, wherein the wand further comprises a control member configured to cause the axial movement of the actuation member.

17. The cleaning system of claim 13, wherein the wand further comprises a biasing member configured to bias the attachment arrangement to the engaged position.

18. The cleaning system of claim 13, wherein the first sealing member comprises an outer edge that is elastically resilient to conform to the top surface of the dissolvable cleaner head.

19. The cleaning system of claim 13, wherein a proximal section of the wand including the first end extends along a wand axis, wherein a distal section of the wand including the second end supporting the attachment arrangement extends along a support axis, and wherein the support axis is inclined with respect to the wand axis.

20. The cleaning system of claim 13, further comprising a plurality of cleaner heads including the cleaning head, and a housing configured to store the wand and the plurality of cleaner heads.

* * * * *